US009890443B2

(12) United States Patent
Lin et al.

(10) Patent No.: US 9,890,443 B2
(45) **Date of Patent: *Feb. 13, 2018**

(54) 6XXX ALUMINUM ALLOYS, AND METHODS FOR PRODUCING THE SAME

(71) Applicant: ARCONIC INC., Pittsburgh, PA (US)

(72) Inventors: Jen C. Lin, Export, PA (US); Anton J. Rovito, Parma, OH (US); Timothy P. Doyle, Wadsworth, OH (US); Shawn P. Sullivan, Oakmont, PA (US); Gabriele F. Ciccola, Hudson, OH (US); Christopher J. Tan, Tallmadge, OH (US)

(73) Assignee: Arconic Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/774,702

(22) Filed: Feb. 22, 2013

(65) Prior Publication Data

US 2014/0017116 A1 Jan. 16, 2014

(51) Int. Cl.

| | |
|---|---|
| ***C22C 21/08*** | (2006.01) |
| ***C22F 1/047*** | (2006.01) |
| ***C22F 1/05*** | (2006.01) |

(52) U.S. Cl.

CPC ..... *C22C 21/08* (2013.01); *C22F 1/047* (2013.01); *C22F 1/05* (2013.01)

(58) Field of Classification Search

CPC ..... C22C 21/08; C22C 21/14; C22C 21/16; C22C 21/00

USPC ..... 420/535

See application file for complete search history.

(56) References Cited

U.S. PATENT DOCUMENTS

| | | | | |
|---|---|---|---|---|
| 3,717,512 | A | 2/1973 | Sperry et al. | 148/32.5 |
| 3,935,007 | A | 1/1976 | Baba et al. | 75/142 |
| 4,525,326 | A | 6/1985 | Schwellinger et al. | 420/535 |
| 4,605,448 | A | 8/1986 | Baba et al. | 148/537 |
| 4,637,842 | A | 1/1987 | Jeffrey et al. | 148/535 |
| 5,223,050 | A * | 6/1993 | Bryant et al. | 148/415 |
| 5,503,690 | A | 4/1996 | Wade et al. | 148/550 |
| 5,527,404 | A | 6/1996 | Warren | 148/688 |
| 5,571,347 | A | 11/1996 | Bergsma | 148/550 |
| 5,766,546 | A * | 6/1998 | Schwellinger | 420/544 |
| 5,961,752 | A * | 10/1999 | Bergsma | 148/550 |
| 6,267,922 | B1 | 7/2001 | Bull et al. | 420/534 |
| 6,364,969 | B1 | 4/2002 | Couper | 148/415 |

(Continued)

FOREIGN PATENT DOCUMENTS

| | | |
|---|---|---|
| JP | 05-009639 | 1/1993 |
| JP | 05-025573 | 2/1993 |

(Continued)

OTHER PUBLICATIONS

Metallic Materials and Elements for Aerospace Vehicle Structure, Jan. 2003.*

(Continued)

*Primary Examiner* — Xiaowei Su
(74) *Attorney, Agent, or Firm* — Greenberg Traurig, LLP

(57) ABSTRACT

New 6xxx aluminum alloys are disclosed. The new 6xxx aluminum alloys may include 1.05-1.50 wt. Mg, 0.60-0.95 wt. % Si, where the (wt. % Mg)/(wt. % Si) is from 1.30 to 1.90, 0.275-0.50 wt. % Cu, and from 0.05 to 1.0 wt. % of at least one secondary element, wherein the secondary element is selected from the group consisting of V, Fe, Cr, Mn, Zr, Ti, and combinations thereof.

19 Claims, 7 Drawing Sheets

(56) References Cited

U.S. PATENT DOCUMENTS

| | | | | |
|---|---|---|---|---|
| 6,846,369 | B1 | 1/2005 | Clark et al. | 148/417 |
| 2009/0061218 | A1* | 3/2009 | Levendusky | C23C 18/00 428/336 |
| 2009/0250144 | A1 | 10/2009 | Kumagai et al. | 148/535 |
| 2012/0055591 | A1 | 3/2012 | Kamat et al. | 148/551 |
| 2012/0234437 | A1 | 9/2012 | Bassi et al. | 148/552 |

FOREIGN PATENT DOCUMENTS

| | | |
|---|---|---|
| JP | 05-247574 | 9/1993 |
| JP | 06-033178 | 2/1994 |
| JP | 07-258784 | 10/1995 |
| JP | 09-248649 | 9/1997 |
| JP | 09-256129 | 9/1997 |
| JP | 11-310841 | 11/1999 |
| JP | 2000-178673 A | 6/2000 |
| JP | 2010-189750 | 9/2010 |
| JP | 2011-252212 | 12/2011 |
| JP | 2012-001756 | 1/2012 |
| WO | WO2007/094686 | 8/2007 |
| WO | WO2007/144186 | 12/2007 |

OTHER PUBLICATIONS

International Search Report and Written Opinion, dated Oct. 14, 2013, from related International Patent Application PCT/US2013/050433.

Rack, H. J., et al., "Thermomechanical Treatment of High Purity 6061 Aluminum" *Metallurgical Transactions A* 8A:335-346, Feb. 1977.

Chinese Office Action, dated Feb. 3, 2016, from related Chinese Application No. 201380036638.4.

Chinese Office Action, dated Oct. 26, 2016, from related, co-owned Chinese Application No. 201380036638.4.

Office Action, dated May 19, 2015, from related, co-owned U.S. Appl. No. 13/861,443, now U.S. Pat. No. 9,556,502.

The Aluminum Association, International Alloy Designations and Chemical Composition Limits for Wrought Aluminum and Wrought Aluminum Alloys, Teal Sheets, pp. 1-28, revised Feb. 2009.

Jogi, B.F. et al., "Some studies on fatigue crack growth rate of aluminum alloy 6061", *Journal of Materials Processing Technology*, 2008, vol. 201, pp. 380-384.

* cited by examiner

FIG. 1a - Example 1 Alloys - Tensile Yield Strength (ksi)
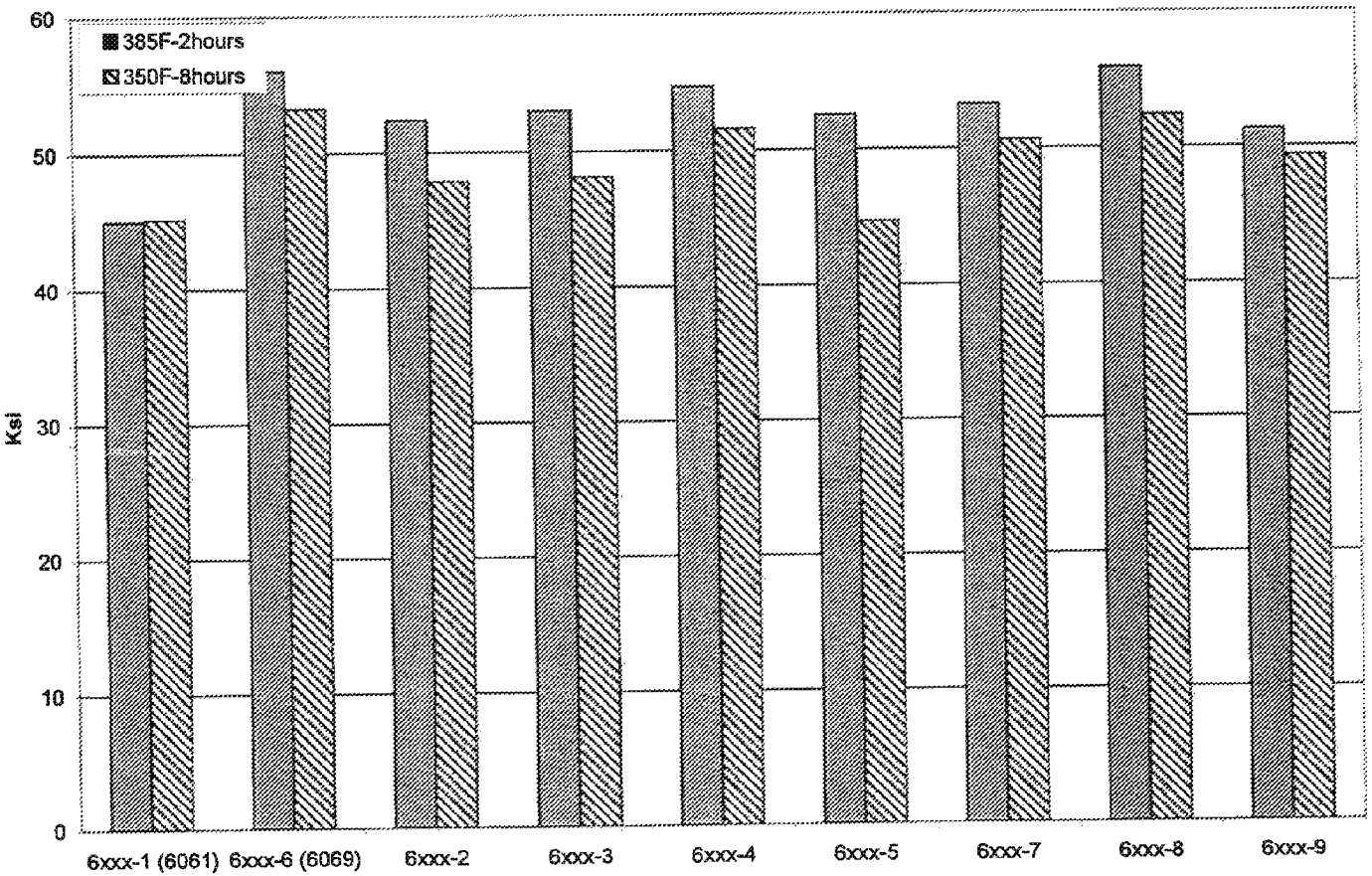

FIG. 1b - Example 1 Alloys - Ultimate Tensile Strength (ksi)
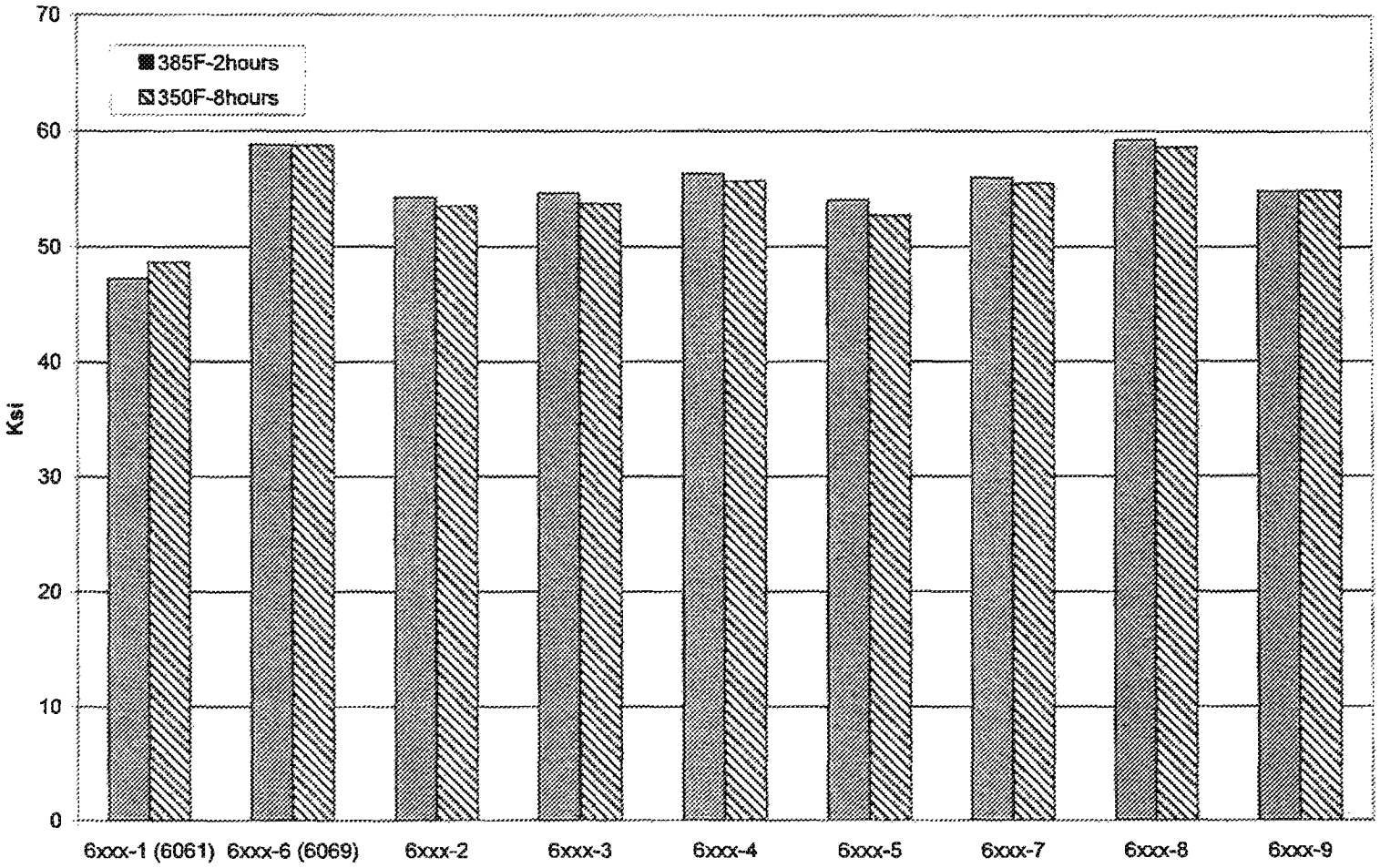

FIG. 1c - Example 1 Alloys - Elongation (%)
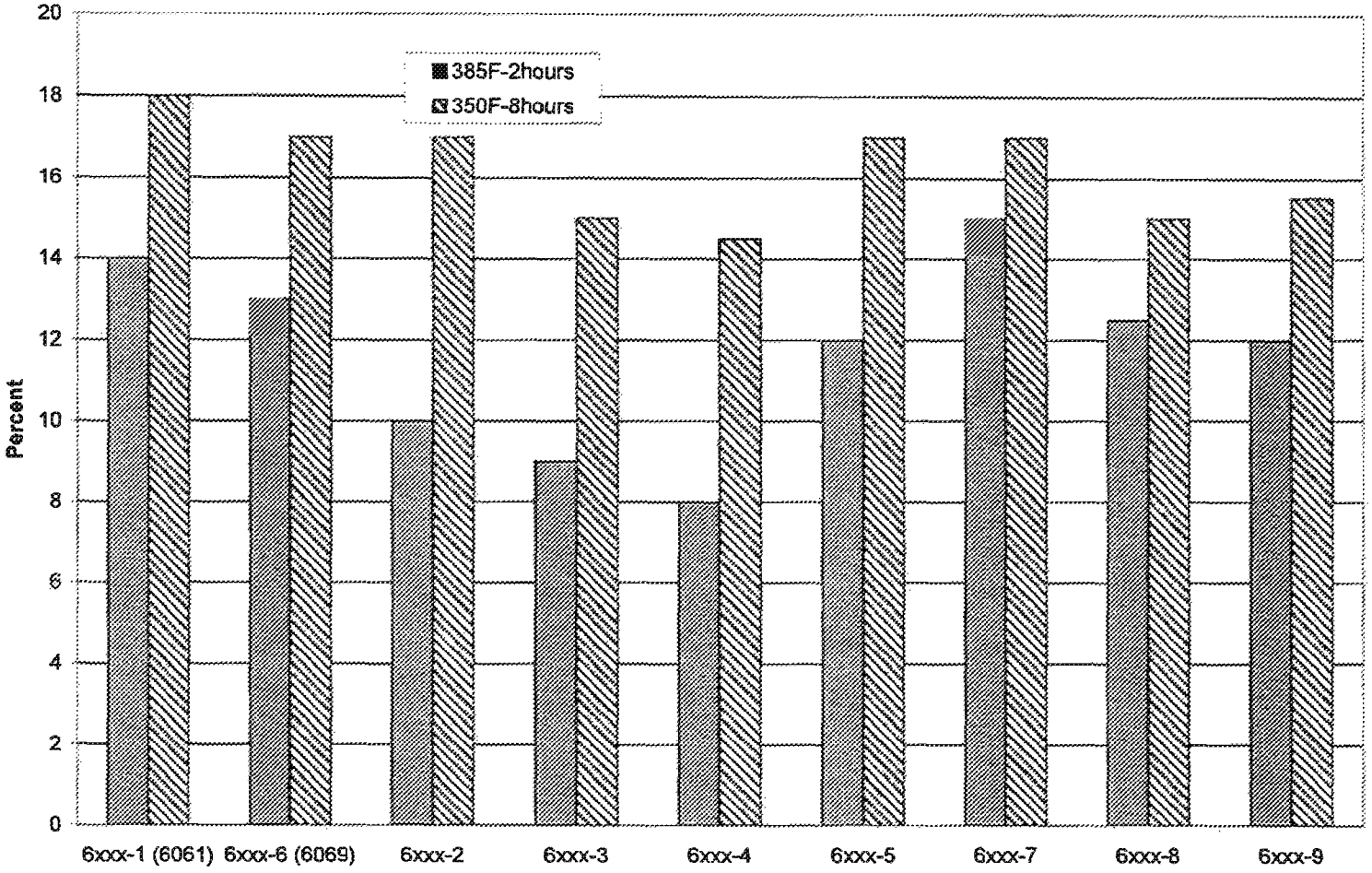

FIG. 1d - Example 1 Alloys - Notched Rotary Fatigue Life (15 ksi, R = -1)
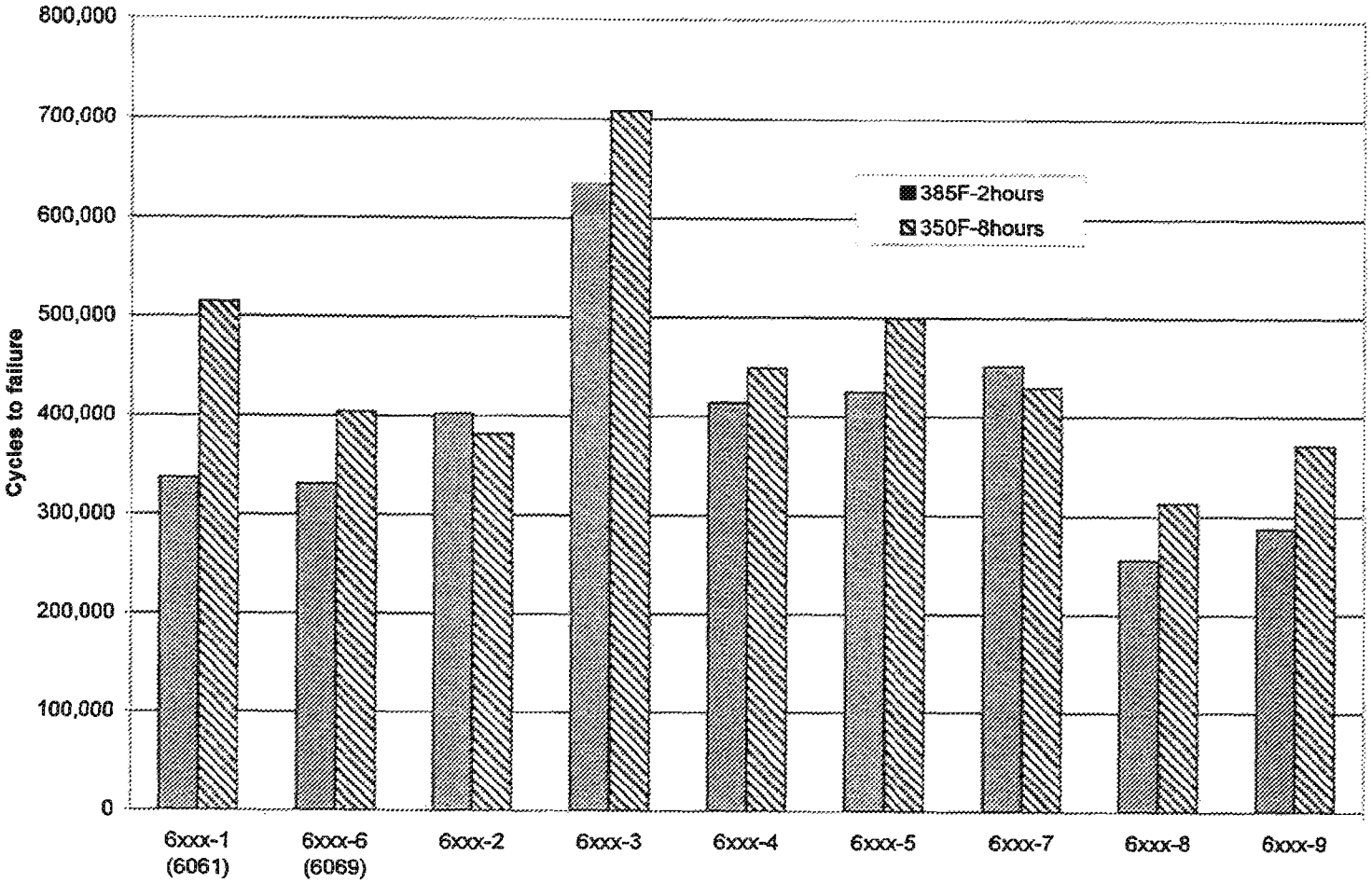

FIG. 1e - Example 1 Alloys - Un-notched Charpy Impact Energy (Ft.-Lbs.)
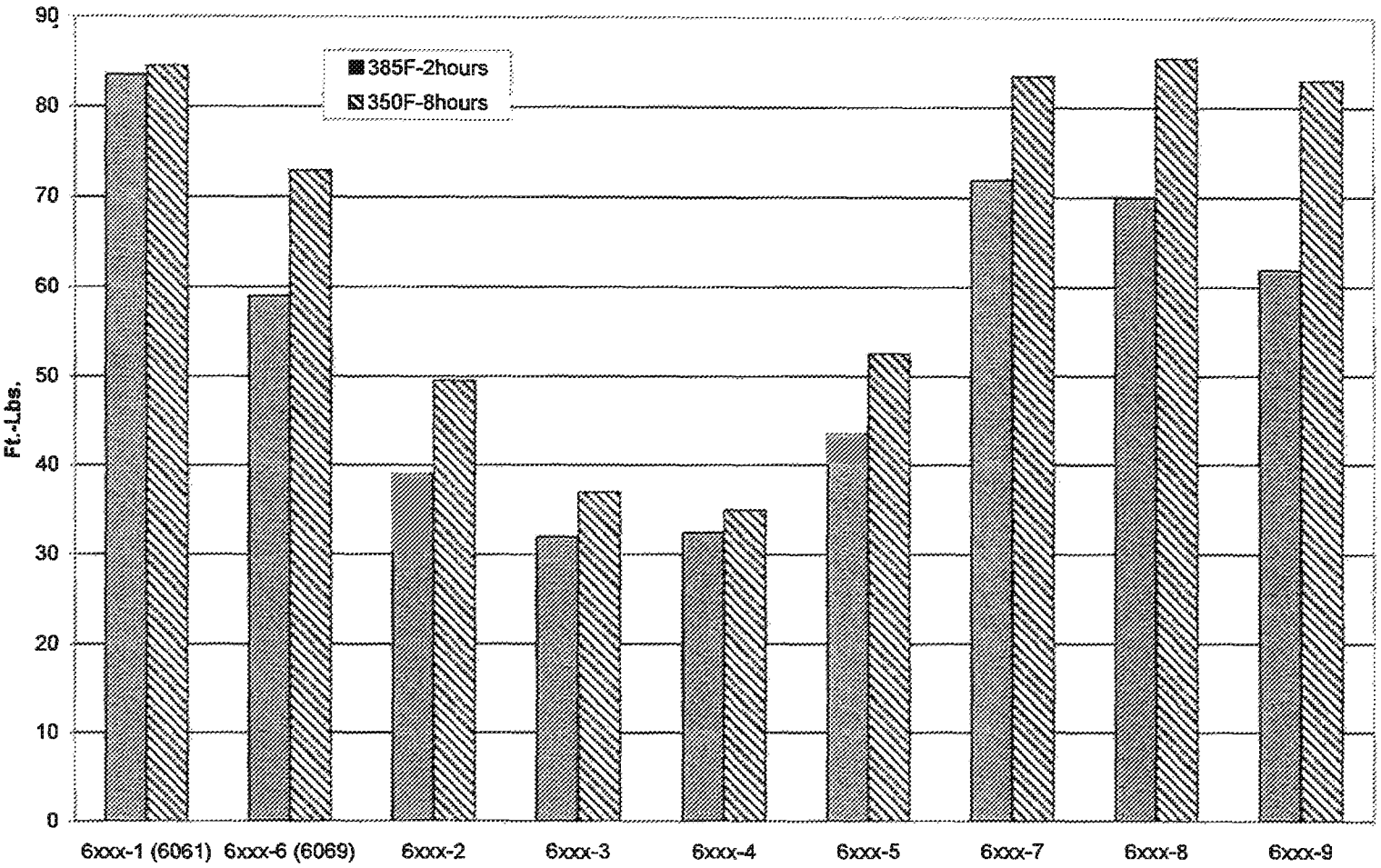

FIG. 1f - Charpy Impact Energy v. Constituent Content
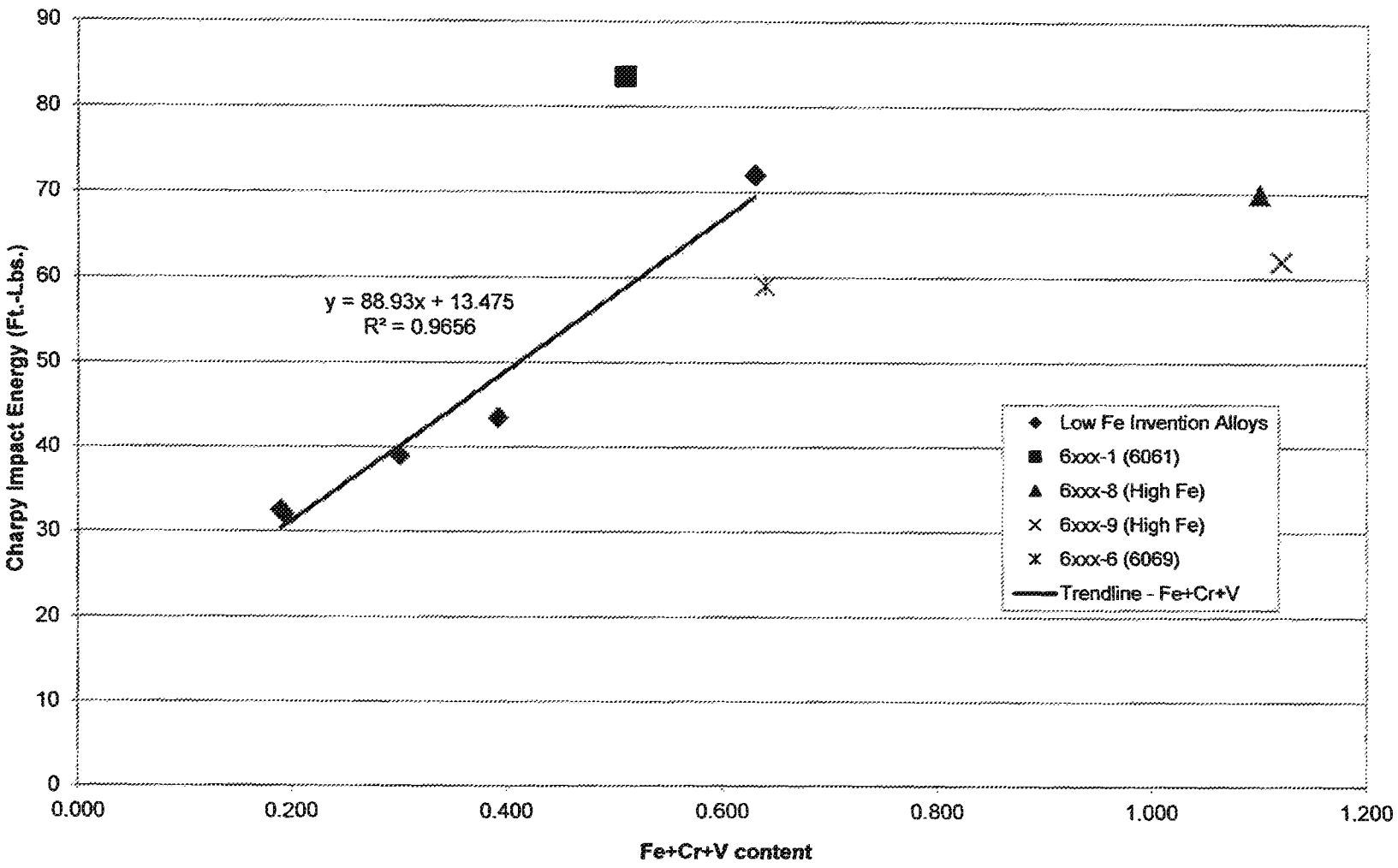

6061
(0.3Fe,0.2Cr
0.08Mn)

6xxx-3
(0.08Fe,0.12Vi)

6xxx-5
(0.05Fe,0.2Cr
0.12Vi)

6xxx-7
(0.25Fe,0.2Cr
0.15Vi)

6XXX ALUMINUM ALLOYS, AND METHODS FOR PRODUCING THE SAME

CROSS-REFERENCE TO RELATED APPLICATIONS

This patent application claims priority to U.S. Provisional Patent Application No. 61/671,969, entitled, "IMPROVED 6XXX ALUMINUM ALLOYS, AND METHODS FOR PRODUCING THE SAME", filed Jul. 16, 2012, and which is incorporated herein by reference in its entirety.

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue resistance, to name two.

SUMMARY OF THE DISCLOSURE

Broadly, the present patent application relates to new 6xxx aluminum alloys, and methods for producing the same. Generally, the new 6xxx aluminum alloy products achieve an improved combination of properties due to, for example, the amount of alloying elements, as described in further detail below. For example, the new 6xxx aluminum alloys may realize an improved combination of two or more of strength, toughness, fatigue resistance, and corrosion resistance, among others, as shown by the below examples. The new 6xxx aluminum alloys may be produced in wrought form, such as an in rolled form (e.g., as sheet or plate), as an extrusion, or as a forging, among others. In one embodiment, the new 6xxx aluminum alloy is in the form of a forged wheel product. In one embodiment, the 6xxx forged wheel product is a die-forged wheel product.

The new 6xxx aluminum alloys generally comprises (and some instances consist essentially of, or consist of) magnesium (Mg), silicon (Si), and copper (Cu) as primary alloying elements and at least one secondary element selected from the group consisting of vanadium (V), manganese (Mn), iron (Fe), chromium (Cr), zirconium (Zr), and titanium (Ti), the balance being aluminum and other impurities, as defined below.

Regarding magnesium, the new 6xxx aluminum alloys generally include from 1.05 wt. % to 1.50 wt. % Mg. In one embodiment, the new 6xxx aluminum alloys include at least 1.10 wt. % Mg. In another embodiment, the new 6xxx aluminum alloys include at least 1.15 wt. % Mg. In yet another embodiment, the new 6xxx aluminum alloys include at least 1.20 wt. % Mg, In one embodiment, the new 6xxx aluminum alloys include not greater than 1.45 wt. % Mg. In another embodiment, the new 6xxx aluminum alloys include not greater than 1.40 wt. % Mg. In yet another embodiment, the new 6xxx aluminum alloys include not greater than 1.35 wt. % Mg.

The new 6xxx aluminum alloys generally include silicon and in the range of from 0.60 wt. % to 0.95 wt. % Si. In one embodiment, the new 6xxx aluminum alloys include at least 0.65 wt. % Si. In another embodiment, the new 6xxx aluminum alloys include at least 0.70 wt. % Si. In one embodiment, the new 6xxx aluminum alloys include not greater than 0.90 wt. % Si. In another embodiment, the new 6xxx aluminum alloys include not greater than 0.85 wt. % Si. In yet another embodiment, the new 6xxx aluminum alloys include not greater than 0.80 wt. % Si.

The new 6xxx aluminum alloys generally include magnesium and silicon in a ratio of from 1.30 to 1.90 (Mg/Si). In one embodiment, the new 6xxx aluminum alloys have a Mg/Si ratio of at least 1.35. In another embodiment, the new 6xxx aluminum alloys have a Mg/Si ratio of at least 1.40. In yet another embodiment, the new 6xxx aluminum alloys have a Mg/Si ratio of at least 1.45. In one embodiment, the new 6xxx aluminum alloys have a. Mg/Si ratio of not greater than 1.85. In another embodiment, the new 6xxx aluminum alloys have a Mg/Si ratio of not greater than 1.80. In yet another embodiment, the new 6xxx aluminum alloys have a Mg/Si ratio of not greater than 1.75. In another embodiment, the new 6xxx aluminum alloys have a Mg/Si ratio of not greater than 1.70. In yet another embodiment, the new 6xxx aluminum alloys have a Mg/Si ratio of not greater than 1.65. In some embodiments, the new 6xxx aluminum alloys have a Mg/Si ratio of from 1.35 to 1.85. In other embodiments, the new 6xxx aluminum alloys have a Mg/Si ratio of from 1.35 to 1.80. In yet other embodiments, the new 6xxx aluminum alloys have a Mg/Si ratio of from 1.40 to 1.75. In other embodiments, the new 6xxx aluminum alloys have a Mg/Si ratio of from 1.40 to 1.70. In yet other embodiments, the new 6xxx aluminum alloys have a Mg/Si ratio of from 1.45 to 1.65. Other combinations of the above-described limits may be used. Using the above described amounts of Mg and Si may facilitate, among other things, improved strength and/or fatigue resistance properties.

The new 6xxx aluminum alloys generally include copper and in the range of from 0.275 wt. % to 0.50 wt. % Cu. In one embodiment, the new 6xxx aluminum alloys include at least 0.30 wt. % Cu. In another embodiment, the new 6xxx aluminum alloys include at least 0.325 wt. % Cu. In yet another embodiment, the new 6xxx aluminum alloys include at least 0.35 wt. % Cu. In one embodiment, the new 6xxx aluminum alloys include not greater than 0.45 wt. % Cu. In another embodiment, the new 6xxx aluminum alloys include not greater than 0.425 wt. % Cu. In yet another embodiment, the new 6xxx aluminum alloys include not greater than 0.40 wt. % Cu. Using the above described amounts of Cu may facilitate improved strength and with good corrosion resistance. As described in further detail below, when the new 6xxx aluminum alloy is substantially free of vanadium (i.e., includes less than 0.05 wt. % V), the new 6xxx aluminum alloy should include at least 0.35 wt. % Cu.

The new 6xxx aluminum alloys include 0.05 to 1.0 wt. % of secondary elements, wherein the secondary elements are selected from the group consisting of vanadium, manganese, chromium, iron, zirconium, titanium, and combinations thereof. In one embodiment, the new 6xxx aluminum alloys include 0.10 to 0.80 wt. % of secondary elements. In another embodiment, the new 6xxx aluminum alloys include 0.15 to 0.60 wt. % of secondary elements. In another embodiment, the new 6xxx aluminum alloys include 0.20 to 0.45 wt. % of secondary elements.

In one embodiment, the secondary elements at least include vanadium, and in these embodiments the new 6xxx aluminum alloy includes at least 0.05 wt. % V. In another embodiment, the secondary elements at least include vanadium and iron. In yet another embodiment, the secondary elements at least include vanadium, iron and titanium. In another embodiment, the secondary elements at least include vanadium, iron, titanium and chromium. In another embodiment, the secondary elements at least include vanadium, iron, titanium and manganese. In yet another embodiment, the secondary elements include all of vanadium, iron, titanium, manganese, and chromium.

In other embodiments, the secondary elements are substantially free of vanadium (i.e., include less than 0.05 wt. % V), and, in these embodiments, the secondary elements are selected from the group consisting of vanadium, manganese, chromium, iron, zirconium, titanium, and combinations thereof, and wherein at least one of manganese, chromium and zirconium is present. In one embodiment, at least chromium is present. In one embodiment, at least chromium and zirconium are present. In one embodiment, at least chromium and manganese are present. In one embodiment, at least zirconium is present. In one embodiment, at least zirconium and manganese are present. In one embodiment, at least manganese is present.

As shown by the below data, vanadium is a useful secondary element, but is not required to be included in the new 6xxx aluminum alloys. In embodiments where vanadium is included, the new 6xxx aluminum alloys include from 0.05 to 0.25 wt. % V. In one embodiment, the new 6xxx aluminum alloys include not greater than 0.20 wt. % V. In another embodiment, the new 6xxx aluminum alloys include not greater than 0.18 wt. % V. In yet another embodiment, the new 6xxx aluminum alloys include not greater than 0.16 wt. % V. In another embodiment, the new 6xxx aluminum alloys include not greater than 0.14 wt. % V. In yet another embodiment, the new 6xxx aluminum alloys include not greater than 0.13 wt. % V. In one embodiment, the new 6xxx aluminum alloys include at least 0.06 wt. % V. In another embodiment, the new 6xxx aluminum alloys include at least 0.07 wt. % V. In some embodiments, the new 6xxx aluminum alloys include from 0.05 to 0.16 wt. % V. In other embodiments, the new 6xxx aluminum alloys include from 0.06 to 0.14 wt. % V. In yet other embodiments, the new 6xxx aluminum alloys include from 0.07 to 0.13 wt. % V. Other combinations of the above-described limits may be used.

In other embodiments, the new 6xxx aluminum alloys are substantially free of vanadium, and, in these embodiments, the new 6xxx aluminum alloys contain less than 0.05 wt. %. V. In these embodiments, chromium, manganese, and/or zirconium may be used as a substitute for the vanadium. In one embodiment, the new 6xxx aluminum alloys contain less than 0.05 wt. % V, but contain a total of from 0.15 to 0.60 wt. % of chromium, manganese, and/or zirconium (i.e., Cr+Mn+Zr is from 0.15 wt. % to 0.60 wt. %). In another embodiment, the new 6xxx aluminum alloys contain less than 0.05 wt. % V, but contain from 0.20 to 0.45 wt. % of chromium, manganese, and/or zirconium. In embodiments where the new 6xxx aluminum alloys are substantially free of vanadium (i.e., the aluminum alloy contains less than 0.05 wt. %. V), the amount of copper in the new 6xxx aluminum alloys should be at least 0.35 wt. % Cu. In some of these vanadium-free embodiments, the new 6xxx aluminum alloys include at least 0.375 wt. % Cu. In others of these vanadium-free embodiments, the new 6xxx aluminum alloys include at least 0.40 wt. % Cu.

In embodiments Where chromium is present (with or without vanadium), the new 6xxx aluminum alloys generally include from 0.05 to 0.40 wt. % Cr. In one embodiment, the new 6xxx aluminum alloys include not greater than 0.35 wt. % Cr. In another embodiment, the new 6xxx aluminum alloys include not greater than 0.30 wt. % Cr. In yet another embodiment, the new 6xxx aluminum alloys include not greater than 0.25 wt. % Cr. In another embodiment, the new 6xxx aluminum alloys include not greater than 0.20 wt. % Cr. In one embodiment, the new 6xxx aluminum alloys include at least 0.08 wt. % Cr. In some embodiments, the new 6xxx aluminum alloys include from 0.05 to 0.25 wt. % Cr. In other embodiments, the new 6xxx aluminum alloys include from 0.08 to 0.20 wt. % Cr. Other combinations of the above-described limits may be used. In some embodiments, the new 6xxx aluminum alloys are substantially free of chromium, and, in these embodiments, contain less than 0.05 wt. %. Cr.

In embodiments where manganese is present (with or without vanadium), the new 6xxx aluminum alloys generally include from 0.05 to 0.50 wt. % Mn. In some embodiments, the new 6xxx aluminum alloys include not greater than 0.25 wt. % Mn. In other embodiments, the new 6xxx aluminum alloys include not greater than 0.20 wt. % Mn. In yet other embodiments, the new 6xxx aluminum alloys include not greater than 0.15 wt. % Mn. In some embodiments, the new 6xxx aluminum alloys include from 0.05 to 0.25 wt. % Mn. In other embodiments, the new 6xxx aluminum alloys include from 0.05 to 0.20 wt. % Mn. In yet other embodiments, the new 6xxx aluminum alloys include from 0.05 to 0.15 wt. % Mn. Other combinations of the above-described limits may be used. In some embodiments, the new 6xxx aluminum alloys are substantially free of manganese, and, in these embodiments, contains less than 0.05 wt. % Mn.

In embodiments where zirconium is present (with or without vanadium), the new 6xxx aluminum alloys generally include from 0.05 to 0.25 wt. % Zr. In some embodiments, the new 6xxx aluminum alloys include not greater than 0.20 wt. % Zr. In other embodiments, the new 6xxx aluminum alloys include not greater than 0.18 wt. % Zr. In yet other embodiments, the new 6xxx aluminum alloys include not greater than 0.15 wt. % Zr. In one embodiment, the new 6xxx aluminum alloys include at least 0.06 wt. % Zr. In yet other embodiments, the new 6xxx aluminum alloys include at least 0.07 wt. % Zr. In some embodiments, the new 6xxx aluminum alloys include from 0.05 to 0.20 wt. % Zr. In other embodiments, the new 6xxx aluminum alloys include from 0.06 to 0.18 wt. % Zr. In yet other embodiments, the new 6xxx aluminum alloys include from 0.07 to 0.15 wt. % Zr. Other combinations of the above-described limits may be used. In some embodiments, the aluminum alloys are substantially free of zirconium, and, in these embodiments, contain less than 0.05 wt. %. Zr.

Iron is generally present in the alloy, and may be present in the range of from 0.01 wt. % to 0.80 wt. % Fe. In some embodiments, the new 6xxx aluminum alloys include not greater than 0.50 wt. % Fe. In other embodiments, the new 6xxx aluminum alloys include not greater than 0.40 wt. % Fe. In yet other embodiments, the new 6xxx aluminum alloys include not greater than 0.30 wt, % Fe. In one embodiment, the new 6xxx aluminum alloys include at least 0.08 wt. % Fe. In yet other embodiments, the new 6xxx aluminum alloys include at least 0.10 wt. % Fe. In some embodiments, the new 6xxx aluminum alloys include from 0.05 to 0.50 wt. % Fe. In other embodiments, the new 6xxx aluminum alloys include from 0.08 to 0.40 wt. % Fe. In yet other embodiments, the new 6xxx aluminum alloys include from 0.10 to 0.30 wt. % Fe. In yet other embodiments, the new 6xxx aluminum alloys include from 0.10 to 0.25 wt. % Fe. Other combinations of the above-described limits may be used. Higher iron levels may be tolerable in new 6xxx aluminum alloy products when lower fatigue resistance properties are tolerable. In some embodiments, the new 6xxx aluminum alloys are substantially free of iron, and, in these embodiments, contain less than 0.01 wt. %. Fe.

In embodiments where titanium is present (with or without vanadium), the new 6xxx aluminum alloys generally include from 0.001 to 0.10 wt. % Ti. In some embodiments, the new 6xxx aluminum alloys include not greater than 0.05 wt. % Ti. In other embodiments, the new 6xxx aluminum alloys include not greater than 0.04 wt. % Ti. In yet other embodiments, the new 6xxx aluminum alloys include not greater than 0.03 wt. % Ti. In one embodiment, the new 6xxx aluminum alloys include at least 0.005 wt. % Ti. In yet other embodiments, the new 6xxx aluminum alloys include at least 0.01 wt. % Ti. In some embodiments, the new 6xxx aluminum alloys include from 0.005 to 0.05 wt. % Ti. In other embodiments, the new 6xxx aluminum alloys include from 0.01 to 0.04 wt. Ti. In yet other embodiments, the new 6xxx aluminum alloys include from 0.01 to 0.03 wt. % Ti. Other combinations of the above-described limits may be used. In some embodiments, the new 6xxx aluminum alloys are substantially free of titanium, and, in these embodiments, contain less than 0.001 wt. Ti.

The new 6xxx aluminum alloys may be substantially free of other elements. As used herein, "other elements" means any other elements of the periodic table other than the above-listed magnesium, silicon, copper, vanadium, iron, chromium, titanium, zirconium, and iron, as described above. In the context of this paragraph, the phrase "substantially free" means that the new 6xxx aluminum alloys contain not more than 0.10 wt. % each of any element of the other elements, with the total combined amount of these other elements not exceeding 0.35 wt. % in the new 6xxx aluminum alloys. In another embodiment, each one of these other elements, individually, does not exceed 0.05 wt. % in the 6xxx aluminum alloys, and the total combined amount of these other elements does not exceed 0.15 wt. % in the 6xxx aluminum alloys. In another embodiment, each one of these other elements, individually, does not exceed 0.03 wt. % in the 6xxx aluminum alloys, and the total combined amount of these other elements does not exceed 0.10 wt. % in the 6xxx aluminum alloys.

The new 6xxx aluminum alloys may achieve high strength. In one embodiment, a wrought product made from the new 6xxx aluminum alloys ("new wrought 6xxx aluminum alloy product") realizes a tensile yield strength in the L (longitudinal) direction of at least 45 ksi. In another embodiment, a new wrought 6xxx aluminum alloy product realizes a tensile yield strength in the L direction of at least 46 ksi. In other embodiments, a new wrought 6xxx aluminum alloy product realizes a tensile yield strength in the L direction of at least 47 ksi, or at least 48 ksi, or at least 49 ksi, or at least about 50 ksi, or at least about 51 ksi, or at least about 52 ksi, or at least about 53 ksi, or at least about 54 ksi, or at least about 55 ksi, or more.

The new 6xxx aluminum alloys may achieve good elongation. In one embodiment, a new wrought 6xxx aluminum alloy product realizes an elongation of at least 6% in the L direction. In another embodiment, a new wrought 6xxx aluminum alloy product realizes an elongation in the L direction of at least 8%. In other embodiments, a new wrought 6xxx aluminum alloy product realizes an elongation in the L direction of at least 10%, or at least 12%, or at least 14%, or more. Strength and elongation properties are measured in accordance with ASTM E8 and 13557.

The new 6xxx aluminum alloys may achieve good toughness. In one embodiment, a new wrought 6xxx aluminum alloy product realizes a toughness of at least 35 ft.-lbs. as measured by a Charpy impact test, wherein the Charpy impact test is performed according to ASTM E23-07a. In another embodiment, a new wrought 6xxx aluminum alloy product realizes a toughness of at least 40 ft.-lbs. as measured by a Charpy impact test. In other embodiments, a new wrought 6xxx aluminum alloy product realizes a toughness of at least 45 ft.-lbs., or at least 50 ft.-lbs., or at least 55 ft.-lbs., or at least 60 ft.-lbs., or at least 65 ft.-lbs., or at least 70 ft.-lbs., or at least 75 or at least 80 ft.-lbs., or at least 85 ft.-lbs., or more, as measured by a Charpy impact test.

The new 6xxx aluminum alloys may achieve good fatigue resistance. In one embodiment, a new wrought 6xxx aluminum alloy product realizes an average rotary fatigue life that is at least 10% better than the average rotary fatigue life of the same wrought product (e.g., the same product form, dimensions, geometry, temper) but made from conventional alloy 6061, wherein the average rotary fatigue life is the average of the rotary fatigue life of at least 5 specimens of the wrought 6xxx aluminum alloy product as tested in accordance with ISO 1143 (2010) ("Metallic materials—Rotating bar bending fatigue testing"), i.e., rotating beam fatigue. In another embodiment, a new wrought 6xxx aluminum alloy product realizes an average rotary fatigue life that is at least 20% better than the average rotary fatigue life of the same wrought product made from conventional alloy 6061. In other embodiments, a new wrought 6xxx aluminum alloy product realizes an average rotary fatigue life that is at least 25% better, or at least 30% better, or at least 40% better, or at least 45% better, or more, than the average rotary fatigue life of the same wrought product made from conventional alloy 6061.

In one embodiment, the new wrought 6xxx aluminum alloy product is a forged wheel product, and the forged 6xxx aluminum alloy wheel product realizes an average radial fatigue life of at least 1,000,000 cycles as tested in accordance with SAE J267 (2007), with a 2.8× load factor applied, in another embodiment, the forged 6xxx aluminum alloy wheel product realizes an average radial fatigue life of at least 1,050,000 cycles. In other embodiments, the forged 6xxx aluminum alloy wheel product realizes an average radial fatigue life of at least 1,100,000 cycles, or at least 1,150,000 cycles, or at least 1,200,000 cycles, or at least 1,250,000 cycles, or at least 1,300,000 cycles, or at least 1,350,000 cycles, or more.

In one embodiment, a new wrought 6xxx aluminum alloy product realizes an average radial fatigue life that is at least 10% better than the average radial fatigue life of the same wrought product (e.g., the same product form, dimensions, geometry, temper) but made from conventional alloy 6061 as tested in accordance with SAE J267 (2007), with a 2.8× load factor applied. In another embodiment, a new wrought 6xxx aluminum alloy product realizes an average radial fatigue life that is at least 20% better than the average radial fatigue life of the same wrought product made from conventional alloy 6061. In other embodiments, a new wrought 6xxx aluminum alloy product realizes an average radial fatigue life that is at least 25% better, or at least 30% better, or at least 40% better, or at least 45% better, or more, than the average radial fatigue life of the same wrought product made from conventional alloy 6061.

The new 6xxx aluminum alloys may achieve good corrosion resistance. In one embodiment, a new wrought 6xxx aluminum alloy product realizes an average depth of attack of not greater than 0.008 inch at the T/10 location when measured in accordance with ASTM G110 (24 hours of exposure; minimum of 5 samples). In another embodiment, a new wrought 6xxx aluminum alloy product realizes an average depth of attack of not greater than 0.006 inch at the T/10 location. In other embodiments, a new wrought 6xxx aluminum alloy product realizes an average depth of attack of not greater than 0.004 inch, or not greater than 0.002 inch, or not greater than 0.001 inch, or less at the T/10 location.

In one embodiment, a new wrought 6xxx aluminum alloy product realizes a maximum depth of attack of not greater than 0.011 inch at the T/10 location when measured in accordance with ASTM G110 (24 hours of exposure; minimum of 5 samples). In another embodiment, a new wrought 6xxx aluminum alloy product realizes a maximum depth of attack of not greater than 0.009 inch at the T/10 location. In other embodiments, a new wrought 6xxx aluminum alloy product realizes a maximum depth of attack of not greater than 0.007 inch, or not greater than 0.005 inch, or not greater than 0.003 inch, or less at the T/10 location.

In one embodiment, a new wrought 6xxx aluminum alloy product realizes an average depth of attack of not greater than 0.008 inch at the surface when measured in accordance with ASTM G110 (24 hours of exposure; minimum of 5 samples). In another embodiment, a new wrought 6xxx aluminum alloy product realizes an average depth of attack of not greater than 0.007 inch at the surface. In other embodiments, a new wrought 6xxx aluminum alloy product realizes an average depth of attack of not greater than 0.006 inch, or not greater than 0.005 inch, or not greater than 0.004 inch, or less at the surface.

In one embodiment, a new wrought 6xxx aluminum alloy product realizes a maximum depth of attack of not greater than 0.010 inch at the surface when measured in accordance with ASTM G110 (24 hours of exposure; minimum of 5 samples). In another embodiment, a new wrought 6xxx aluminum alloy product realizes a maximum depth of attack of not greater than 0.009 inch at the surface. In other embodiments, a new wrought 6xxx aluminum alloy product realizes a maximum depth of attack of not greater than 0.008 inch, or not greater than 0.007 inch, or not greater than 0.006 inch, or less at the surface.

Combinations of the above described properties may be achieved, as shown by the below examples.

BRIEF DESCRIPTION OF THE DRAWINGS

FIGS. 1*a*-1*f* are graphs showing results from Example 1.

DETAILED DESCRIPTION

Example 1—Book Mold Study

Nine book mold ingots were produced, the compositions of which are provided in Table 1, below (all values in weight percent).

TABLE 1

Example 1 Alloy Compositions

| Alloy | Si | Fe | Cu | Mn | Mg | Cr | V | Ti |
|---|---|---|---|---|---|---|---|---|
| 6xxx-1 (6061) | 0.70 | 0.290 | 0.28 | 0.07 | 0.90 | 0.22 | 0.00 | 0.015 |
| 6xxx-2 (Inv.) | 0.87 | 0.190 | 0.29 | 0.00 | 1.38 | 0.00 | 0.11 | 0.015 |
| 6xxx-3 (Inv.) | 0.89 | 0.083 | 0.29 | 0.00 | 1.40 | 0.00 | 0.11 | 0.010 |
| 6xxx-4 (Inv.) | 0.88 | 0.080 | 0.44 | 0.00 | 1.40 | 0.00 | 0.11 | 0.010 |
| 6xxx-5 (Inv.) | 0.90 | 0.082 | 0.30 | 0.00 | 1.37 | 0.20 | 0.11 | 0.009 |
| 6xxx-6 (6069) | 0.90 | 0.270 | 0.70 | 0.00 | 1.36 | 0.21 | 0.16 | 0.009 |
| 6xxx-7 (Inv.) | 0.94 | 0.260 | 0.46 | 0.00 | 1.37 | 0.21 | 0.16 | 0.010 |
| 6xxx-8 (Non. Inv.) | 0.89 | 0.730 | 0.69 | 0.00 | 1.34 | 0.21 | 0.16 | 0.010 |
| 6xxx-9 (Non. Inv.) | 0.91 | 0.760 | 0.45 | 0.00 | 1.36 | 0.21 | 0.15 | 0.009 |

Alloys 6061 and 6069 are conventional 6xxx aluminum alloys. All alloys contained the listed elements, the balance being aluminum and other impurities, where the other impurities did not exceed more than 0.05 wt. % each, and not more than 0.15 wt. % total of the other impurities. The invention alloys have a Mg/Si ratio of from 1.46 to 1.59.

Figures 1, 1G:
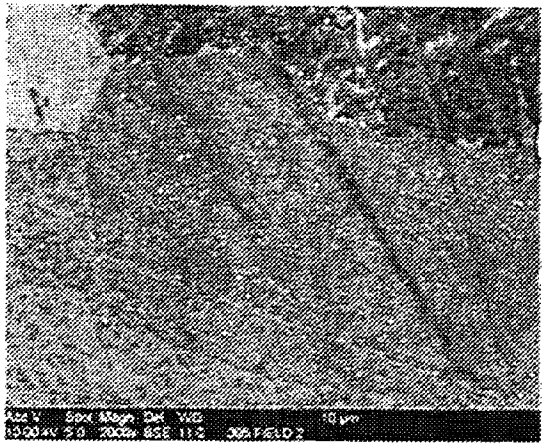
FIGS. 1-1 to 1*g*-4 are micrographs from Example 1.

The alloys were cast as 2.875 inch (ST)×4.75 inch (LT)×17 inch (L) ingots that were scalped to 2 inches thick and then homogenized. The ingots were then hot rolled to about 0.5 inch plates, corresponding to approximately a 75% reduction. The plates were subsequently solution heat-treated and cold water quenched (100° F.). The plates were then aged at 385° F. and 350° F. for different times, and aging curves were generated. Based on the aging curve results, two aging conditions (385° F. for 2 hours, and 350° F. for 8 hours) were selected for testing of various properties. The aging condition of 385° F. for 2 hours generally represents about peak strength, and the aging condition of 350° F. for 8 hours generally represents an underaged condition. The test results are illustrated in FIGS. 1*a*-1*f* and provided in Tables 2-7, below. Strength and elongation properties were measured in accordance with ASTM E8 and B557. Charpy impact tests were measured in accordance with ASTM E23-07a. Rotary fatigue life tests were conducted in accordance with ISO 1143 (2010) at a stress of 15 ksi, with R=−1 and with Kt=3. Corrosion resistance was tested in accordance with ASTM G110 for 24 hours.

TABLE 2

Mechanical Properties of Alloys - Peak Strength Condition (385° F. for 2 hours)

| Alloy | TYS (ksi) | UTS (ksi) | Elong. (%) | Charpy Impact (ft-lbs) | Rotary Fatigue Life (Ave.) |
|---|---|---|---|---|---|
| 6xxx-1 (6061) | 45.1 | 47.25 | 14 | 83.5 | 337,103 |
| 6xxx-2 | 52.4 | 54.25 | 10 | 39 | 402,549 |
| 6xxx-3 | 53 | 54.65 | 9 | 32 | 634,978 |
| 6xxx-4 | 54.65 | 56.35 | 8 | 32.5 | 414,013 |
| 6xxx-5 | 52.55 | 54.05 | 12 | 43.5 | 424,909 |
| 6xxx-6 (6069) | 56 | 58.85 | 13 | 59 | 331,770 |
| 6xxx-7 | 53.25 | 56 | 15 | 72 | 451,075 |
| 6xxx-8 | 55.85 | 59.3 | 12.5 | 70 | 255,579 |
| 6xxx-9 | 51.25 | 54.85 | 12 | 62 | 287,496 |

TABLE 3

Mechanical Properties of Alloys - Underaged Condition (350° F. for 8 hours)

| Alloy | TYS (ksi) | UTS (ksi) | Elong. (%) | Charpy Impact (ft-lbs) | Rotary Fatigue Life (Ave.) |
|---|---|---|---|---|---|
| 6xxx-1 (6061) | 45.2 | 48.7 | 18 | 84.5 | 514,840 |
| 6xxx-2 | 47.9 | 53.5 | 17 | 49.5 | 381,533 |
| 6xxx-3 | 48.15 | 53.7 | 15 | 37 | 708,003 |
| 6xxx-4 | 51.6 | 55.7 | 14.5 | 35 | 449,002 |
| 6xxx-5 | 44.7 | 52.7 | 17 | 52.5 | 499,260 |
| 6xxx-6 (6069) | 53.25 | 58.75 | 17 | 73 | 404,120 |
| 6xxx-7 | 50.6 | 55.5 | 17 | 83.5 | 429,141 |
| 6xxx-8 | 52.35 | 58.7 | 15 | 85.5 | 313,281 |
| 6xxx-9 | 49.3 | 54.9 | 15.5 | 83 | 371,073 |

TABLE 4

Corrosion Properties of Alloys - Peak Strength Condition (385° F. for 2 hours)

| Alloy | G110 - Depth of Attack - 24 hours (in.) | | | |
|---|---|---|---|---|
| | T/10 (ave.) | T10 (max.) | Surface (ave.) | Surface (max.) |
| 6xxx-1 (6061) | 0.00754 | 0.00997 | 0.00936 | 0.01294 |
| 6xxx-2 | 0.00539 | 0.00808 | 0.00699 | 0.00952 |
| 6xxx-3 | 0.00064 | 0.00109 | 0.00514 | 0.00724 |
| 6xxx-4 | 0.00534 | 0.00686 | 0.00817 | 0.00562 |
| 6xxx-5 | 0.00105 | 0.00230 | 0.00465 | 0.00574 |
| 6xxx-6 (6069) | 0.00391 | 0.00552 | 0.00517 | 0.00555 |
| 6xxx-7 | 0.00348 | 0.00438 | 0.00573 | 0.00657 |
| 6xxx-8 | 0.00765 | 0.00958 | 0.00565 | 0.00666 |
| 6xxx-9 | 0.00758 | 0.01030 | 0.00756 | 0.00893 |

TABLE 5

Corrosion Properties of Alloys - Underaged Condition (350° F. for 8 hours)

| Alloy | G110 - Depth of Attack - 24 hours (in) | | | |
|---|---|---|---|---|
| | T/10 (ave.) | T10 (max.) | Surface (ave) | Surface (max.) |
| 6xxx-1 (6061) | 0.01044 | 0.01385 | 0.00822 | 0.01141 |
| 6xxx-2 | 0.00348 | 0.00934 | 0.00657 | 0.00838 |
| 6xxx-3 | 0.00373 | 0.00573 | 0.00639 | 0.00736 |
| 6xxx-4 | 0.00641 | 0.00879 | 0.00795 | 0.01010 |
| 6xxx-5 | 0.00274 | 0.00443 | 0.00607 | 0.00670 |
| 6xxx-6 (6069) | 0.00449 | 0.00533 | 0.00681 | 0.00810 |
| 6xxx-7 | 0.00397 | 0.00515 | 0.00662 | 0.00736 |
| 6xxx-8 | 0.00749 | 0.00824 | 0.00332 | 0.00570 |
| 6xxx-9 | 0.00774 | 0.00960 | 0.00688 | 0.01058 |

FIGS. 1*a*-1*c* illustrates the tensile properties of the alloys. All the tested alloys have a higher near peak strength than conventional alloy 6061.

FIG. 1*d* illustrates the rotary fatigue life of the alloys. Alloys having high more than 0.7 wt. % Fe (i.e., alloys 6xxx-8 and 6xxx-9) realize lower fatigue life. Alloys 6xxx-8 and 6xxx-9 also contain more than 1.0 wt. % of the secondary elements of vanadium (V), manganese (Mn), iron (Fe), chromium (Cr), zirconium (Zr), and titanium (Ti), which contributes to their low fatigue performance. Furthermore, Alloys 6 and 8, having about 0.7 wt. % Cu realize worse fatigue performance than their counterpart alloys, illustrating the importance of maintaining copper below about 0.55 wt. %.

FIG. 1*e* illustrates the un-notched charpy impact energy of the alloys. Charpy impact energy is an indicator of fracture toughness. Unexpectedly, the charpy impact energy increased with increasing constituent forming elements (e.g., Fe, Cr, and V). A correlation plot is given in FIG. 1*f*. This trend is inverse to the normal trend, where charpy impact energy generally decreases with increasing constituent particle concentration in aluminum alloys.

Tables 4 and 5 provide corrosion data relating to depth of attack testing per ASTM G110 (24 hours test). All the alloys show better or similar corrosion resistance compared to the conventional alloy 6061.

Color and gloss of the alloys were also tested. The invention alloys achieved comparable color and gloss performance relative to conventional alloy 6061, both before and after DURA-BRIGHT processing (see, U.S. Pat. No. 6,440,290).

Figures 1, 1G, 2:
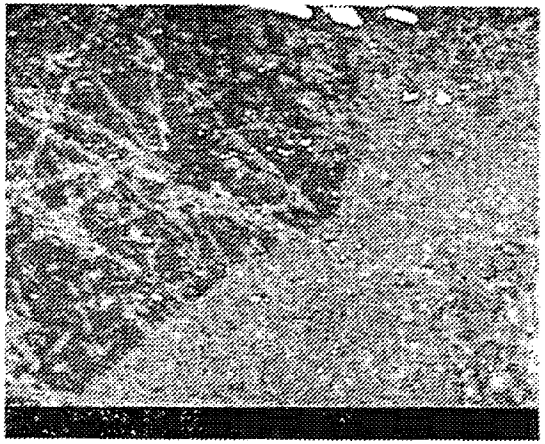
Figures 1, 1G, 2, 3:
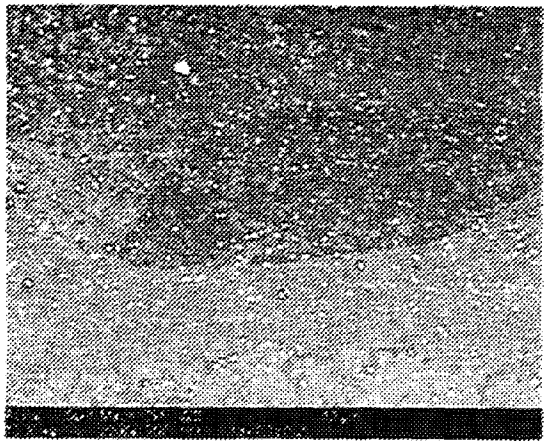
Figures 1, 1G, 2, 3, 4:
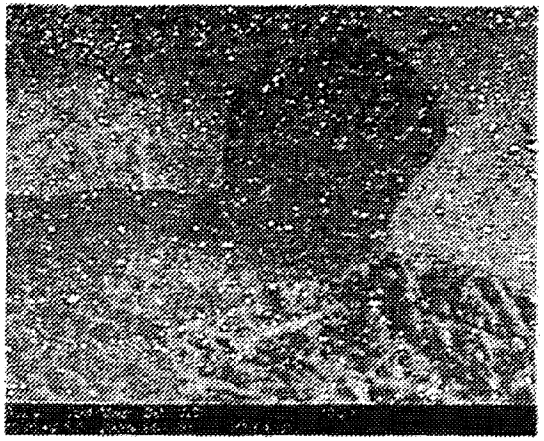

Micrographs of various ones of the alloys were also obtained, some of which are illustrated in FIGS. 1*g*-1 to 1*g*-4. Both the amount of dispersoids and the uniformity of distribution of dispersoids were improved by the combined additions of V and Cr. Furthermore, the microstructures of the alloys with V+Cr additions are more unrecrystallized, as shown in FIGS. 1*g*-3 and 1*g*-4.

Example 2—Additional Book Mold Study

Seven additional book mold ingots were produced per the procedure of Example 1, except the alloys were all aged at 385° F. for 2 hours. The compositions of the Example 2 alloys are provided in Table 6, below (all values in weight percent).

TABLE 6

Example 2 Alloy Compositions

| Alloy | Si | Fe | Cu | Mn | Mg | Cr | V | Zr | Ti |
|---|---|---|---|---|---|---|---|---|---|
| 6xxx-10 | 0.72 | 0.15 | 0.34 | — | 1.24 | 0.21 | — | — | 0.013 |
| 6xxx-11 | 0.72 | 0.15 | 0.34 | — | 1.24 | 0.19 | 0.07 | — | 0.014 |
| 6xxx-12 | 0.74 | 0.15 | 0.34 | — | 1.26 | 0.22 | 0.11 | — | 0.015 |
| 6xxx-13 | 0.72 | 0.16 | 0.34 | 0.09 | 1.26 | 0.21 | 0.11 | — | 0.012 |
| 6xxx-14 | 0.73 | 0.15 | 0.34 | — | 1.20 | — | 0.11 | 0.11 | 0.024 |
| 6xxx-15 | 0.70 | 0.15 | 0.34 | 0.14 | 1.17 | — | 0.13 | — | 0.018 |
| 6xxx-16 | 0.72 | 0.16 | 0.35 | 0.14 | 1.20 | — | 0.12 | 0.10 | 0.018 |

All alloys contained the listed elements, the balance being aluminum and other impurities, where the other impurities did not exceed more than 0.05 wt. % each, and not more than 0.15 wt. % total of the other impurities. These alloys have a Mg/Si ratio of from 1.64 to 1.75.

Mechanical properties of these alloys were tested, the results of which are provided in Table 7, below. Strength and elongation properties were measured in accordance with ASTM E8 and B557. Rotary fatigue life tests were conducted in accordance with ISO 1143 (2010) at a stress of 15 ksi, with R=−1 and with Kt=3. As shown in Table 7, the alloys having appropriate amounts of Si, Mg and at the appropriate Si/Mg ratio achieved improved fatigue resistance properties and with high strength. Indeed, the alloys generally have negligible amounts of excess Si and Mg, helping the alloys to achieve the improved properties; all achieved improved properties over alloy 6061 (6xxx-1 from Example 1) due to, at least in part, the amount of Si, Mg and the Si/Mg ratio, and irrespective of the amount of Mn, Cr, and V used. It is observed, however, that alloys having vanadium with at least one of manganese and chromium generally achieved high strength in combination with improved resistance to fatigue.

TABLE 7

Mechanical Properties of Alloys - 385° F. for 2 hours

| Alloy | TYS (ksi) | UTS (ksi) | Elong. (%) | Charpy Impact (ft-lbs) | Rotary Fatigue Life (Ave.) |
|---|---|---|---|---|---|
| 6xxx-10 | 46.1 | 49.4 | 16 | 59.0 | 461900 |
| 6xxx-11 | 46.8 | 49.9 | 16 | 73.5 | 439909 |
| 6xxx-12 | 48.65 | 51.25 | 15 | 80.5 | 471108 |
| 6xxx-13 | 48.3 | 52.1 | 17 | 88.0 | 456419 |
| 6xxx-14 | 47.3 | 52.75 | 16 | 49.0 | 467624 |
| 6xxx-15 | 49.65 | 53.05 | 15 | 61.5 | 482539 |
| 6xxx-16 | 47.35 | 52.6 | 16 | 65.0 | 466159 |

Example 3—Wheel Study

Two invention compositions and seven comparative compositions were produced as wheels. Specifically, nine ingots having the compositions provided in Table 8, below, were produced by direct chill casting, after which they were homogenized, and then die forged into a wheel, after which the wheels were solution heat treated, quenched, and then artificially aged at 385° F. for about 2 hours.

TABLE 8

Example 3 Alloy Compositions

| Alloy | Mg | Si | Fe | Mn | Cr | Cu | V |
|---|---|---|---|---|---|---|---|
| Alloy 17 (Inv.) | 1.10 | 0.77 | 0.20 | 0 | 0.11 | 0.4 | 0.10 |
| Alloy 18 (Inv.) | 1.24 | 0.76 | 0.15 | 0 | 0.18 | 0.35 | 0.11 |
| Alloy 19 (Non-Inv.) | 1.40 | 0.90 | 0.25 | 0.6 | 0.15 | 0.15 | 0 |
| Alloy 20 (Non-Inv.) | 1.59 | 0.58 | 0.28 | 0.55 | 0.20 | 0.15 | 0 |
| Alloy 21 (Non-Inv.) | 0.70 | 0.80 | 0.20 | 0.31 | 0.20 | 0.26 | 0 |
| Alloy 22 (Non-Inv.) | 0.70 | 0.80 | 0.22 | 0.53 | 0.13 | 0.25 | 0 |
| Alloy 23 (Non-Inv.) | 0.86 | 0.69 | 0.31 | 0.076 | 0.20 | 0.3 | 0 |
| AA6061 | 0.92 | 0.7 | 0.30 | 0.08 | 0.21 | 0.29 | 0 |
| AA6082 | 0.75 | 1.04 | 0.21 | 0.54 | 0.14 | 0.04 | 0 |

All alloys contained the listed elements and about 0.02 wt. % Ti, the balance being aluminum and other impurities, where the other impurities did not exceed more than 0.05 wt. % each, and not more than 0.15 wt. % total of the other impurities. The invention alloys have a Mg/Si ratio of from 1.43 to 1.63.

Mechanical properties of the wheel products were tested, the results of which are provided in Table 9, below.

Strength and elongation properties were measured in accordance with ASTM E8 and B557. Radial fatigue life was conducted in accordance with SAE J267 (2007), with a 2.8× load factor applied. As shown in Table 9, the invention alloys generally achieved both higher strength and improved fatigue life over the conventional and non-invention alloys.

TABLE 9

Mechanical Properties of Wheels - 385° F. for hours

| Alloy | TYS (ksi) | UTS (ksi) | Elong. (%) | Radial Fatigue Life (Ave.) |
|---|---|---|---|---|
| Alloy 17 (Inv.) | 51.6 | 53.8 | 13.7 | 1,170,062 |
| Alloy 18 (Inv.) | 50.4 | 53.4 | 16.0 | 1,331,779 |
| Alloy 19 (Non-Inv.) | 47.5 | 51.8 | 13.4 | 784,237 |
| Alloy 20 (Non-Inv.) | 41.6 | 47.6 | 14.8 | 393,296 |
| Alloy 21 (Non-Inv.) | 46.8 | 53.9 | 17.3 | 753,077 |
| Alloy 22 (Non-Inv.) | 46.0 | 53.2 | 16.3 | 778,972 |
| Alloy 23 (Non-Inv.) | 46.7 | 48.5 | 13.3 | 850,413 |
| AA6061 | 47.1 | 49.0 | 17.0 | 942,683 |
| AA6082 | 47.4 | 49.7 | 8.0 | 650,036 |

Example 4—Additional Book Mold Study

Ten additional book mold ingots were produced per the procedure of Example 1, except the alloys were all aged at 385° F. for 2 hours. The compositions of the Example 4 alloys are provided in Table 10, below (all values in weight percent).

TABLE 10

Example 4 Alloy Compositions

| Alloy | Si | Fe | Cu | Mn | Mg | Mg/Si | Cr | V |
|---|---|---|---|---|---|---|---|---|
| Alloy 24 (Inv.) | 0.77 | 0.14 | 0.36 | — | 1.20 | 1.56 | 0.19 | 0.09 |
| Alloy 25 (Inv.) | 0.74 | 0.12 | 0.34 | — | 1.20 | 1.62 | 0.11 | 0.08 |
| Alloy 26 (Inv.) | 0.77 | 0.15 | 0.39 | 0.02 | 1.17 | 1.52 | 0.14 | 0.06 |
| Alloy 27 (Inv.) | 0.74 | 0.13 | 0.35 | 0.02 | 1.18 | 1.60 | 0.28 | — |
| Alloy 28 (Inv.) | 0.73 | 0.17 | 0.37 | 0.12 | 1.17 | 1.60 | 0.02 | 0.09 |
| Alloy 29 (Inv.) | 0.75 | 0.15 | 0.37 | 0.36 | 1.21 | 1.61 | 0.02 | 0.07 |
| Alloy 30 (Inv.) | 0.72 | 0.13 | 0.36 | 0.14 | 1.16 | 1.61 | 0.24 | — |
| Alloy 31 (Inv.) | 0.75 | 0.18 | 0.37 | 0.11 | 1.19 | 1.59 | 0.11 | 0.06 |
| Alloy 32 (Non-inv.) | 1.14 | 0.14 | 0.36 | 0.02 | 1.22 | 1.07 | 0.20 | 0.10 |
| Alloy 33 (Non-inv.) (6061) | 0.67 | 0.3 | 0.26 | 0.08 | 0.86 | 1.28 | 0.23 | — |

All alloys contained the listed elements and about 0.02 wt. % Ti, the balance being aluminum and other impurities, where the other impurities did not exceed more than 0.05 wt. % each, and not more than 0.15 wt. % total of the other impurities. The invention alloys have a Mg/Si ratio of from 1.52 to 1.62.

The alloys were cast as 2.875 inch (ST)×4.75 inch (LT)× 17 inch (L) ingots that were scalped to 2 inches thick and then homogenized. The ingots were then machined into about 1.5 inch diameter cylinders (3 inches in height) and then deformed into disks having a final thickness of about 0.52 inch. The disks were subsequently solution heat treated and cold water quenched (100° F.), and then aged at 385° F. for 2 hours. Strength and elongation properties were measured in accordance with ASTM E8 and B557. Rotary fatigue life tests were conducted in accordance with ISO 1143 (2010) at a stress of 15 ksi, with R=−1 and with Kt=3. Results are provided in Table 11, below.

TABLE 11

Mechanical Properties of Example 4 Alloys

| Alloy | TYS (ksi) | UTS (ksi) | Elong. (%) | Rotary Fatigue Life (Ave.) |
|---|---|---|---|---|
| Alloy 24 (Inv.) | 49.8 | 51.75 | 11.5 | 433362 |
| Alloy 25 (Inv) | 42.5 | 47.35 | 18 | 477147 |
| Alloy 26 (Inv.) | 45.95 | 49.85 | 16 | 465299 |
| Alloy 27 (Inv.) | 39.6 | 46.65 | 20.5 | 388834 |
| Alloy 28 (Inv.) | 49.05 | 51.05 | 12 | 430464 |
| Alloy 29 (Inv.) | 43.75 | 47.85 | 17.5 | 392867 |
| Alloy 30 (Inv.) | 47.75 | 49.65 | 13 | 453965 |
| Alloy 31 (Inv.) | 40 | 46.85 | 21 | 419481 |
| Alloy 32 (Non-inv.) | 54.8 | 56.65 | 4.5 | 428743 |
| Alloy 33 (Non-inv.) (6061) | 42.8 | 44.4 | 13.5 | 330573 |

As shown, the invention alloys realize improved properties over non-invention alloy 33 (6061-type). Alloys 24-26, 28-29 and 31 having vanadium realized about equivalent or improved strength over non-invention alloy 33 (6061-type) and with improved rotary fatigue life and good elongation. Alloys 27 and 30, which did not contain vanadium, but contained chromium and manganese, achieved improved rotary fatigue life over non-invention alloy 33 (6061-type) and with good elongation. Non-invention alloy 32, having 1.14 Si and a Mg/Si ratio of 1.07 realizes poor elongation.

Example 5—Additional Book Mold Study

Seven additional book mold ingots were produced, the compositions of which are provided in Table 13, below (all values in weight percent).

TABLE 13

Example 5 Alloy Compositions

| Alloy | Si | Fe | Cu | Mn | Mg | Mg/Si | Cr | V |
|---|---|---|---|---|---|---|---|---|
| Alloy 34 (Inv.) | 0.71 | 0.14 | 0.33 | 0 | 1.12 | 1.58 | 0 | 0.11 |
| Alloy 35 (Inv.) | 0.77 | 0.16 | 0.34 | 0 | 1.19 | 1.55 | 0.18 | 0 |
| Alloy 36 (Non-inv.) | 0.62 | 0.16 | 0.28 | 0 | 0.96 | 1.55 | 0.19 | 0 |
| Alloy 37 (Non-inv.) | 0.92 | 0.16 | 0.35 | 0 | 1.14 | 1.24 | 0 | 0.10 |
| Alloy 38 (Non-inv.) | 0.72 | 0.22 | 0.30 | 0.07 | 1.16 | 1.61 | 0.19 | 0 |
| Alloy 39 (Non-inv.) | 0.75 | 0.15 | 0.19 | 0 | 1.14 | 1.52 | 0 | 0.10 |
| Alloy 40 (Non-inv.) (6061) | 0.71 | 0.21 | 0.27 | 0.08 | 0.88 | 1.24 | 0.21 | 0 |

All alloys contained the listed elements and about 0.01-0.02 wt. % Ti, the balance being aluminum and other impurities, where the other impurities did not exceed more than 0.05 wt. % each, and not more than 0.15 wt. % total of the other impurities. The invention alloys have a Mg/Si ratio of from 1.55 to 1.58. The alloys were processed the same as Example 1, except they were only aged at 385° F. for 2 hours. Strength and elongation properties were measured in accordance with ASTM E8 and B557. Results are provided in Table 14, below.

TABLE 14

Mechanical Properties of Example 5 Alloys

| Alloy | TYS (ksi) | UTS (ksi) | Elong. (%) |
|---|---|---|---|
| Alloy 34 (Inv.) | 50.2 | 53.8 | 8.5 |
| Alloy 35 (Inv.) | 48.3 | 52.0 | 13.5 |
| Alloy 36 (Non-inv.) | 46.3 | 48.6 | 13.5 |
| Alloy 37 (Non-inv.) | 51.5 | 54.3 | 3.0 |
| Alloy 38 (Non-inv.) | 44.7 | 48.8 | 15.5 |
| Alloy 39 (Non-inv.) | 45.9 | 50.3 | 10.5 |
| Alloy 40 (Non-inv.) (6061) | 46.4 | 47.9 | 14.0 |

As shown, the invention alloys realize improved properties over non-invention alloy 40 (6061-type). Specifically, alloys 34-35 achieved improved tensile yield strength (TYS) over non-invention alloy 40 (6061-type) and with good elongation, although Alloy 34 with vanadium achieved higher strength. Non-invention alloy 36 with 0.62 wt. % Si, 0.96 wt. % Mg, 0.28 wt. % Cu, and no vanadium achieved about the same tensile yield strength and elongation as non-invention alloy non-invention alloy 40 (6061-type). Non-invention alloy 37 with 0.92 wt. % Si and a Mg/Si ratio of 1.24 achieved low elongation. Non-invention alloy 38 with 0.30 wt. % Cu and a Mg/Si ratio of 1.61, but no vanadium achieved a lower yield strength than non-invention alloy non-invention alloy 40 (6061-type). Non-invention alloy 39 with 0.19 wt. % Cu achieved a lower yield strength than non-invention alloy non-invention alloy 40 (6061-type).

The above results indicate that alloys with at least 0.05 wt. % vanadium may achieve improved properties when employing, among other things, at least 0.275 wt. % Cu and the appropriate amount of Si and Mg, as shown above. The above results also indicate that alloys without at least 0.05 wt. % vanadium may achieve improved properties by employing at least 0.35 wt. % Cu, and with the appropriate amount of Si, Mg and by using Cr, Mn and/or Zr as a substitute for V.

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. A forged 6xxx aluminum alloy wheel product consisting of:

(a) 1.05-1.50 wt. Mg;

(b) 0.65-0.95 wt. % Si;

wherein (wt. % Mg)/(wt. % Si) is from 1.40 to 1.90;

(c) 0.275-0.50 wt. % Cu;

(d) from 0.15-0.60 wt. % of at least one secondary element, wherein the secondary element is selected from the group consisting of V, Fe, Cr, Mn, Zr, Ti, and combinations thereof;

wherein at least V is present and wherein the forged 6xxx aluminum alloy wheel product includes from 0.05 wt. % to 0.25 wt. % V as a secondary element;

wherein, when present, the forged 6xxx aluminum alloy wheel product includes not greater than 0.30 wt. % Fe as a secondary element;

wherein, when present, the forged 6xxx aluminum alloy wheel product includes not greater than 0.25 wt. % Mn as a secondary element;

wherein, when present, the forged 6xxx aluminum alloy wheel product includes not greater than 0.30 wt. % Cr as a secondary element;

wherein, when present, the forged 6xxx aluminum alloy wheel product includes not greater than 0.18 wt. % Zr as a secondary element;

wherein, when present, the forged 6xxx aluminum alloy wheel product includes not greater than 0.10 wt. % Ti as a secondary element;

(e) the balance being aluminum and other elements, wherein each one of the other elements does not exceed 0.05 wt. % in the forged 6xxx aluminum alloy wheel product, and wherein the total of the other elements is not more than 0.15 wt. % in the forged 6xxx aluminum alloy wheel product;

wherein the forged 6xxx aluminum alloy wheel product realizes a longitudinal tensile yield strength of at least 49 ksi and an elongation of at least 10% when tested in accordance with ASTM E8 and B557.

2. The forged 6xxx aluminum alloy wheel product of claim 1, wherein the Si content is 0.70-0.95 wt. %.

3. The forged 6xxx aluminum alloy wheel product of claim 2, wherein the Mg content is 1.10-1.50 wt. %.

4. The forged 6xxx aluminum alloy wheel product of claim 3, wherein the Cu content is 0.30-0.50 wt. %.

5. The forged 6xxx aluminum alloy wheel product of claim 4, wherein the V content is 0.05 to 0.20 wt. %.

6. The forged 6xxx aluminum alloy wheel product of claim 4, wherein the V content is 0.06 to 0.14 wt. %.

7. The forged 6xxx aluminum alloy wheel product of claim 1, wherein the Si content is 0.65-0.90 wt. %.

8. The forged 6xxx aluminum alloy wheel product of claim 7, wherein the Mg content is 1.05-1.40 wt. %.

9. The forged 6xxx aluminum alloy wheel product of claim 1, wherein the Si content is 0.65-0.85 wt. %.

10. The forged 6xxx aluminum alloy wheel product of claim 9, wherein the Mg content is 1.05-1.35 wt. %.

11. The forged 6xxx aluminum alloy wheel product of claim 1, wherein the Si content is 0.65-0.80 wt. %.

12. The forged 6xxx aluminum alloy wheel product of claim 11, wherein the Mg content is 1.05-1.30 wt. %.

13. A forged 6xxx aluminum alloy wheel product consisting of:

(a) 1.05-1.50 wt. Mg;

(b) 0.65-0.95 wt. % Si;

wherein (wt. % Mg)/(wt. % Si) is from 1.40 to 1.90;

(c) 0.275-0.50 wt. % Cu;

(d) from 0.15-0.60 wt. % of at least one secondary element, wherein the secondary element is selected from the group consisting of V, Fe, Cr, Mn, Zr, Ti, and combinations thereof;

wherein at least V is present and wherein the forged 6xxx aluminum alloy wheel product includes from 0.05 wt. % to 0.25 wt. % V as a secondary element;

wherein, when present, the forged 6xxx aluminum alloy wheel product includes not greater than 0.30 wt. % Fe as a secondary element;

wherein, when present, the forged 6xxx aluminum alloy wheel product includes not greater than 0.25 wt. % Mn as a secondary element;

wherein, when present, the forged 6xxx aluminum alloy wheel product includes not greater than 0.30 wt. % Cr as a secondary element;

wherein, when present, the forged 6xxx aluminum alloy wheel product includes not greater than 0.18 wt. % Zr as a secondary element;

wherein, when present, the forged 6xxx aluminum alloy wheel product includes not greater than 0.10 wt. % Ti as a secondary element;

(e) the balance being aluminum and other elements, wherein each one of the other elements does not exceed 0.05 wt. % in the forged 6xxx aluminum alloy wheel product, and wherein the total of the other elements is not more than 0.15 wt. % in the forged 6xxx aluminum alloy wheel product;

wherein the forged 6xxx aluminum alloy wheel product realizes a longitudinal tensile yield strength of at least 45 ksi and an elongation of at least 8% when tested in accordance with ASTM E8 and B557; and wherein the forged wheel product realizes an average radial fatigue life of at least 1,000,000 cycles as tested in accordance with SAE (Society of Automobile Engineers) Standard No. J267 (2007), with a 2.8× load factor applied.

14. The forged 6xxx aluminum alloy wheel product of claim 13, wherein the forged 6xxx wheel product realizes an average radial fatigue life of at least 1,050,000 cycles.

15. The forged 6xxx aluminum alloy wheel product of claim 13, wherein the forged 6xxx wheel product realizes an average radial fatigue life of at least 1,100,000 cycles.

16. The forged 6xxx aluminum alloy wheel product of claim 13, wherein the forged 6xxx wheel product realizes an average radial fatigue life of at least 1,150,000 cycles.

17. The forged 6xxx aluminum alloy wheel product of claim 13, wherein the forged 6xxx wheel product realizes an average radial fatigue life of at least 1,200,000 cycles.

18. The forged 6xxx aluminum alloy wheel product of claim 13, wherein the forged 6xxx aluminum alloy wheel product realizes a longitudinal tensile yield strength of at least 47 ksi and an elongation of at least 10% when tested in accordance with ASTM E8 and B557.

19. The forged 6xxx aluminum alloy wheel product of claim 13, wherein the forged 6xxx aluminum alloy wheel product realizes a longitudinal tensile yield strength of at least 49 ksi and an elongation of at least 10% when tested in accordance with ASTM E8 and B557.

* * * * *